United States Patent [19]

Lataix

[11] Patent Number: 4,936,446

[45] Date of Patent: Jun. 26, 1990

[54] PACKAGING AND DISPENSING SYSTEM FOR PACKAGING TWO INGREDIENTS SEPARATELY AND MIXING THEM EXTEMPORANEOUSLY AT THE TIME OF FIRST USE, AND METHOD OF ASSEMBLING SAME

[75] Inventor: Gilbert Lataix, Chatelguyon, France

[73] Assignee: Laboratoires Merck, Sharp & Dohme-Chibret, Paris, France

[21] Appl. No.: 317,249

[22] Filed: Feb. 28, 1989

[30] Foreign Application Priority Data

Mar. 2, 1988 [FR] France ..... 88 02612

[51] Int. Cl.[5] ..... B65D 25/08

[52] U.S. Cl. ..... 206/221; 206/219; 222/529

[58] Field of Search ..... 206/219, 220, 221; 222/145, 532, 529

[56] References Cited

U.S. PATENT DOCUMENTS

| | | | |
|---|---|---|---|
| 1,275,315 | 9/1989 | Smith | 206/221 |
| 2,689,566 | 9/1954 | Lockhart | 206/221 |
| 3,872,867 | 3/1975 | Killinger | 206/219 |
| 3,917,063 | 11/1975 | Chibret et al. | 206/221 |

FOREIGN PATENT DOCUMENTS

| | | |
|---|---|---|
| 7816912 | 1/1980 | France . |
| 1429656 | 2/1976 | United Kingdom . |

*Primary Examiner*—Paul T. Sewell
*Assistant Examiner*—Jacob K. Ackun, Jr.
*Attorney, Agent, or Firm*—William H. Nicholson; Joseph F. DiPrima

[57] ABSTRACT

A packaging and dispensing system provides for separate packaging of two ingredients of which at least one is a liquid and for extemporaneous mixing of the two ingredients at the time of first use. The system comprises a first bottle (2) containing the liquid or solid first ingredient and the neck of which is stoppered by a plug (5, 8). It further comprises a second bottle (9) containing the liquid second ingredient and assembled to the first bottle (2) at its neck. There is also an internal coupling member (11) carried by the second bottle (9) and the end of which is coupled to the plug (8). This coupling is obtained automatically when the two bottles are assembled together. A cap (13)screwed onto the second bottle (9) is coupled to the coupling member (11) so that at the time of first use unscrewing the cap (13) initially displaces the plug (8) and establishes automatically the communication between the two bottles without compromising any sterile conditions that may apply. The system may be used in particular for packaging and dispensing eyedrop.

8 Claims, 12 Drawing Sheets

FIG_1
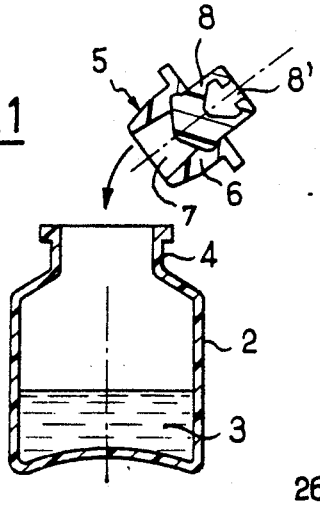
FIG_2
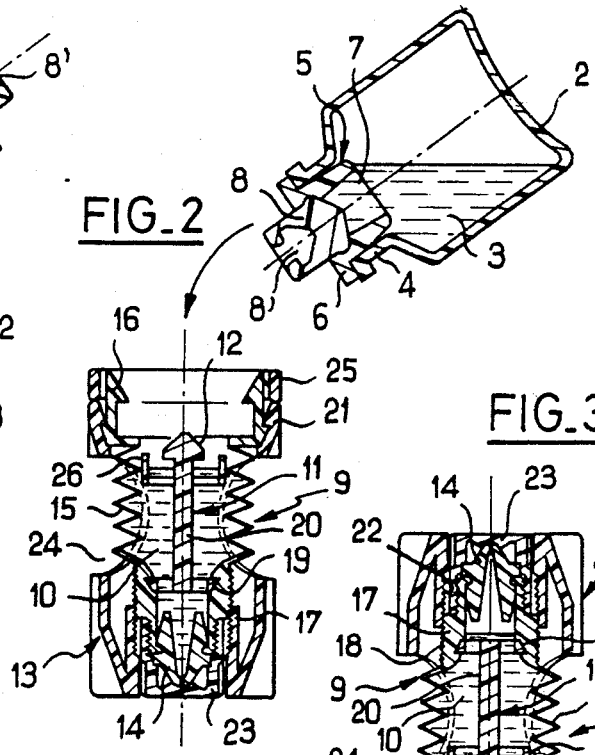
FIG_3
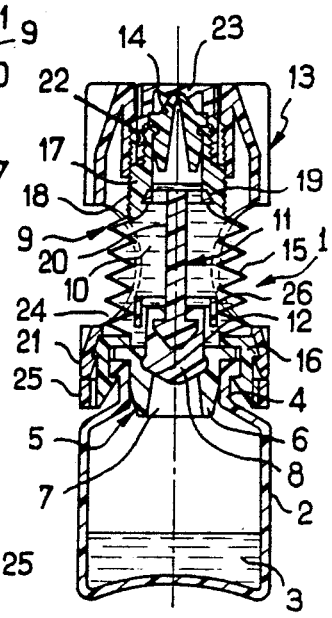
FIG_4
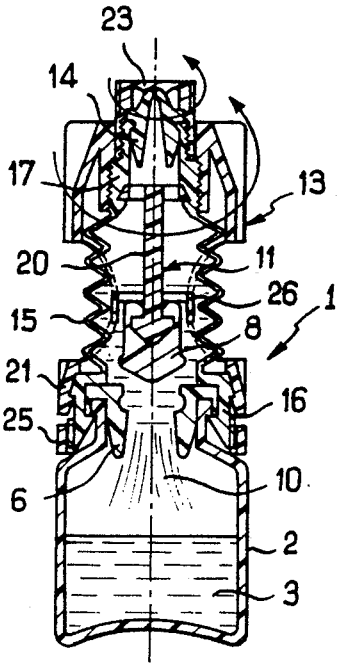
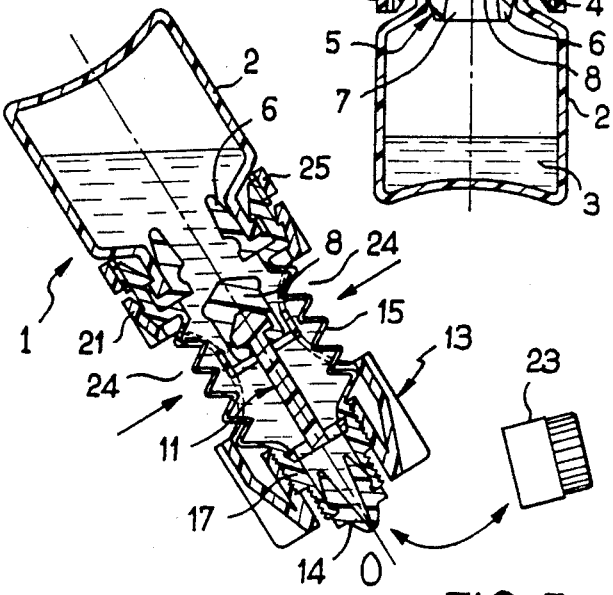
FIG_5

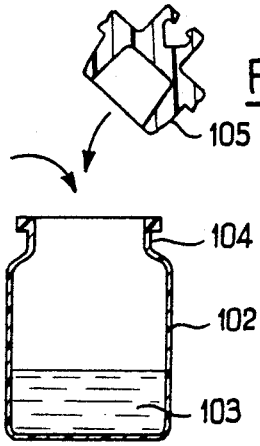
FIG. 6
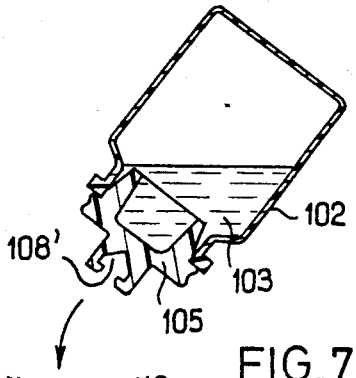
FIG. 7
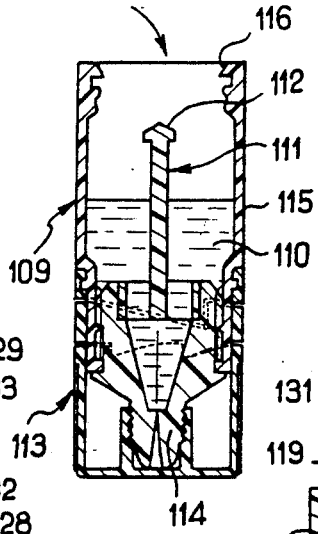
FIG. 8
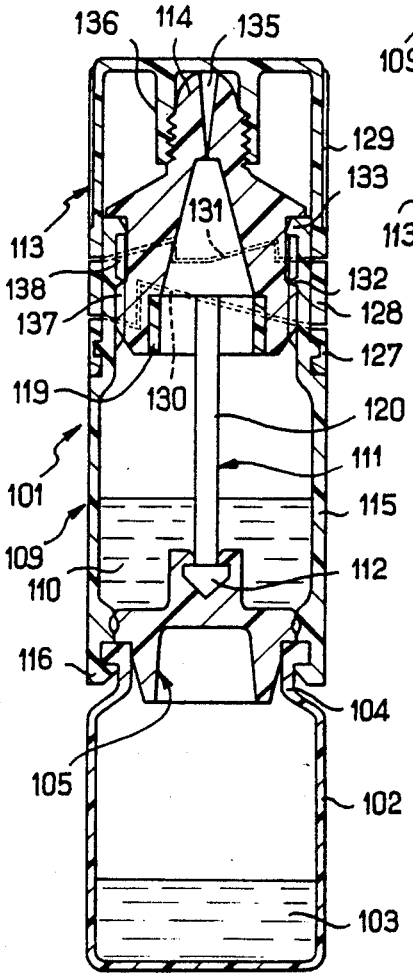
FIG. 9
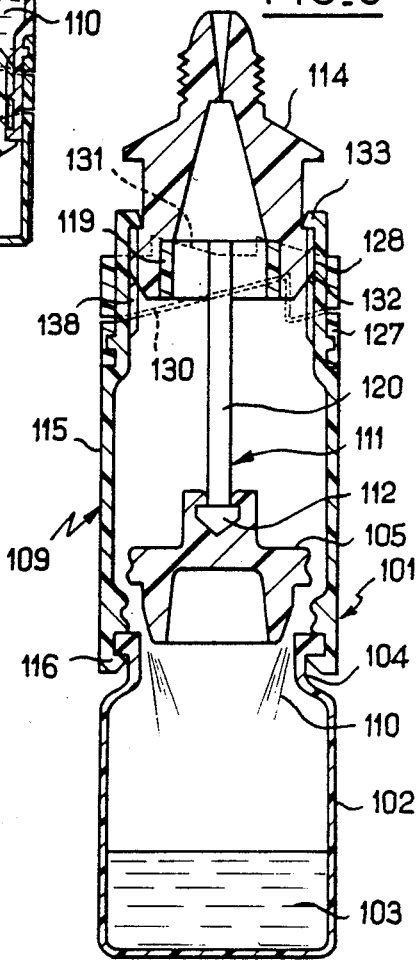

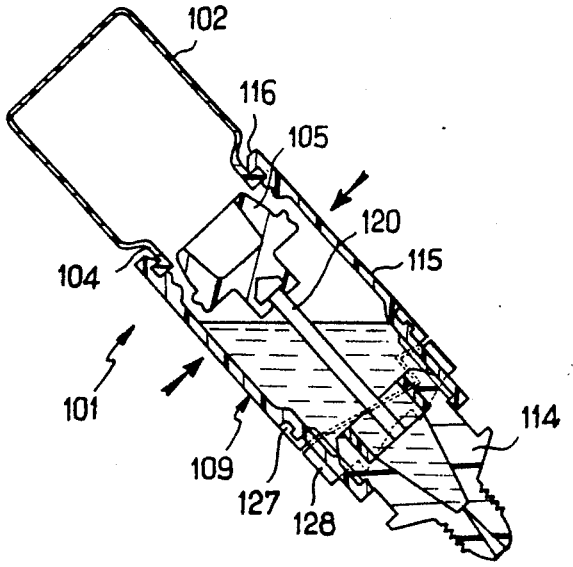
FIG_10
FIG_11
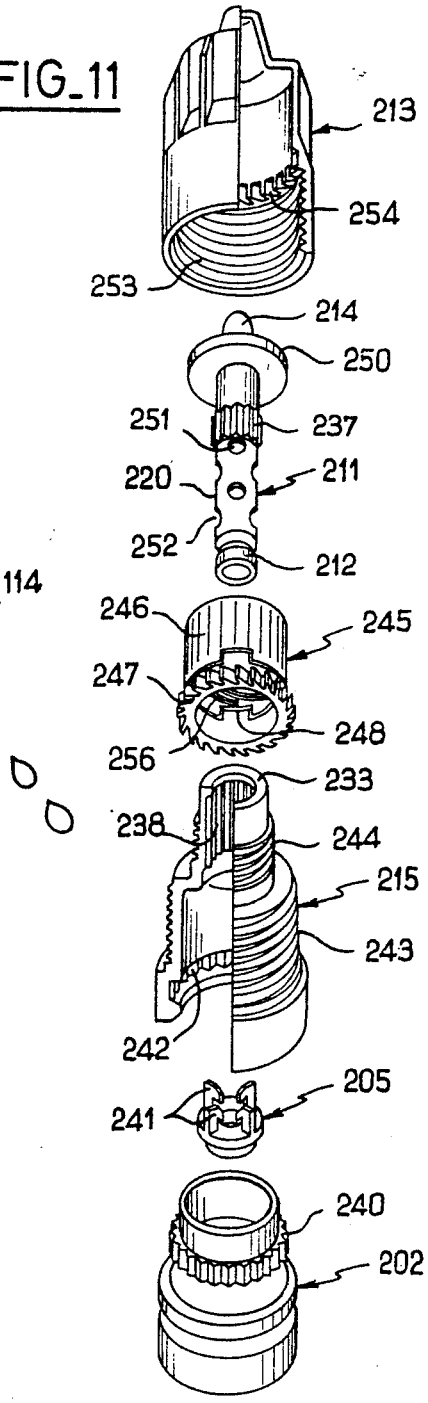

PACKAGING AND DISPENSING SYSTEM FOR PACKAGING TWO INGREDIENTS SEPARATELY AND MIXING THEM EXTEMPORANEOUSLY AT THE TIME OF FIRST USE, AND METHOD OF ASSEMBLING SAME

BACKGROUND OF THE INVENTION

1. Field of the invention

The present invention concerns the packaging and dispensing of ingredients that are required to be mixed extemporaneously at the time of first use.

2. Description of the prior art

For a long time two separate bottles were used, a first bottle containing the solvent and a second bottle the substance to be dissolved, in freeze-dried form, for example, or, in the case where both ingredients are liquids, with two separate bottles each containing a liquid.

To prepare the solution, the user opened both bottles, poured the solvent into the second bottle containing the substance to be dissolved and closed the latter before shaking it to promote the process of dissolution or mixing of the two ingredients.

This type of method has numerous disadvantages (handling problems, risk of spilling some of the solvent, risk of contamination so that the preparation is no longer sterile, etc).

There have been numerous experiments with methods for producing a packaging and dispensing system comprising two separate bottles between which communication is provided automatically when they are screwed together. Mention might be made of the following French patents, for example: No. 1 233 412, No. 1 486 502, No. 1 508 658, No. 2 190 094, No. 2 238 644, No. 2 279 378 and No 2 427 960.

In these methods, mixing is achieved by a deliberate action of the user and it cannot really be said that all the disadvantages of previous methods are overcome (risk of contamination of sterile products, risk of loss of some of the ingredients, risk of only one of the ingredients being used and, more generally, difficulties in operating or explaining the method to be adopted).

There have also been proposed packaging and dispensing systems whereby extemporaneous mixing of the ingredients is achieved by a screwing or unscrewing motion. Generally speaking, these methods are based on the presence of a cover closing one bottle that is pushed back by screwing one bottle onto the other, which then establishes communication between the two bottles (in some cases the cover is hinged to the bottle and in others it is unattached). Mention may be made here of French patents No. 2 476 607 and No. 2 506 726, for example, and European patent No. 0 243 730.

These various methods still have disadvantages, however, given the risk of handling errors and the risk of subsequent separation of the chambers of the two bottles.

It is obvious, for example, that the system described in French patent No. 2 506 726 cannot prevent the dispensing of a quantity of unmixed product.

In the case of eyedrop type preparations, it is essential for it to be impossible under any circumstances to dispense a droplet of unmixed product.

There have also been produced systems with two coaxial chambers and a separator plug featuring axial bores into which are inserted, in as fluid-tight a way as possible, a cylindrical portion attached to the lower bottle: thus, when the upper bottle is unscrewed the plug is drawn out until the bores are opened which then enables communication between the two bottles. It has been found that methods of this type are not satisfactory since in practise the seal remains less than perfect and the component parts are of complicated shape which makes them difficult to manufacture by injection molding, especially where systems with large dimensions are required.

Mention should also be made of a solution proposed for glass bottles with two coaxial chambers delimited by a transverse wall in which there is a central orifice, as shown in French patent No. 1 514 479: a flat disk or a cone joined to a cap can close the aforementioned central orifice so that opening the cap enables communication between the two chambers. Solutions of this type concern only packaging for extemporaneous mixing and not dispensing of the mixed product (the field in question is that of laboratory equipment). What is more, the previously mentioned disadvantages (imperfect seal, no protection against violation) are also encountered to which are added the risk of pollution of the upper chamber when filling the lower chamber (which is a major disadvantage in the case of incompatible liquids) and handling difficulties (the difficulty of securing the disk or cone before the cap is applied).

An object of the invention is to provide a packaging and dispensing system offering enhanced performance as compared with the methods outlined hereinabove.

Another object of the invention is to provide a system that can be adapted to the case of two liquid ingredients (wet/wet preparations) and to the case where one of the ingredients is in powder form, especially freeze-dried, in which case the associated bottle is made from glass (wet/dry preparations).

A further object of the invention is to provide a packaging and dispensing system which satisfies in an optimum way the various working hypotheses outlined below:

- it is impossible to use one of the two ingredients in non-mixed form;
- it is impossible to re-partition the two chambers of the bottles after the opening effected for their first use, unless de-partitioning is automatic on the next use;
- automatic mixing of the ingredients is possible by natural gestures: a rational and logical system is required, in particular one avoiding complicated gestures (for example tightening then untightening for use);
- easy manipulation in terms of the forces to be applied (especially the unscrewing torque), such forces to be compatible with use by elderly persons;
- total inviolability, in respect of both the manufacturer during manufacture and the user, or otherwise proof of opening to be visible externally;
- design to be suited to industrialization, both of manufacture (molding, packaging) and of handling on high-speed conveyor systems (continuous production lines).

SUMMARY OF THE INVENTION

In one aspect, the present invention consists in a packaging and dispensing system for packaging separately two ingredients at least one of which is a liquid and mixing said two ingredients extemporaneously at the time of first use, said system comprising:

- a first bottle to contain the liquid or solid first ingredient and a plug to close the neck of said first bottle;

a second bottle to contain the liquid second ingredient adapted to be assembled to said first bottle at its neck;

an internal coupling member carried by said second bottle of elongate shape and having one end adapted to be coupled automatically to said plug closing said first bottle when said first and second bottles are assembled together;

a dispensing nozzle carried by said second bottle; and a cap screwed onto said second bottle and coupled to said internal coupling member in such a way that on said first use unscrewing said cap initially displaces said plug and so automatically establishes the communication between said first and second bottles to enable safe mixing without prejudice to sterile conditions and subsequently uncovers said dispensing nozzle.

In a second aspect, the present invention consists in a method of assembling a packaging and dispensing system as defined in the preceding paragraph, which method comprises the steps of:

depositing a required quantity of a liquid or solid first ingredient in said first bottle;

stopping said first bottle by means of said plug;

depositing a required quantity of a liquid second ingredient in said second bottle while it is upside down with said dispensing nozzle facing downwards and said cap screwed on; and assembling said first bottle to said second bottle, whereby said coupling of said internal coupling member to said plug is automatically procured.

Other characteristics and advantages of the invention will emerge more clearly from the following description and the appended drawings, which concern specific embodiments.

BRIEF DESCRIPTION OF THE DRAWINGS

FIGS. 1 through 3 show in cross-section the assembly of a packaging and dispensing system in accordance with the invention in a first embodiment with a bellows-like main body, FIG. 3 showing the product ready for use.

FIG. 4 is an axial cross-section showing the communication established by unscrewing for mixing prior to first use of the previous system and FIG. 5 shows it in use.

FIGS. 6 through 8 show in cross-section the assembly of a system in accordance with the invention in a second embodiment where the cap is in three separable parts, FIG. 8 showing the product ready for use.

FIG. 9 is an axial cross-section showing the communication established by unscrewing, after separation of the parts forming the cap, before first use of the system shown in FIG. 8 and FIG. 10 shows it in use.

FIGS. 11 and 12 respectively shown an exploded view and an axial cross-section in the assembled state of a third embodiment of the invention, the packaging and dispensing system comprising an intermediate bush providing a rotational drive coupling and a sliding member forming both a coupling to the plug and a dispensing nozzle.

DESCRIPTION OF THE PREFERRED EMBODIMENTS

Figure 12:
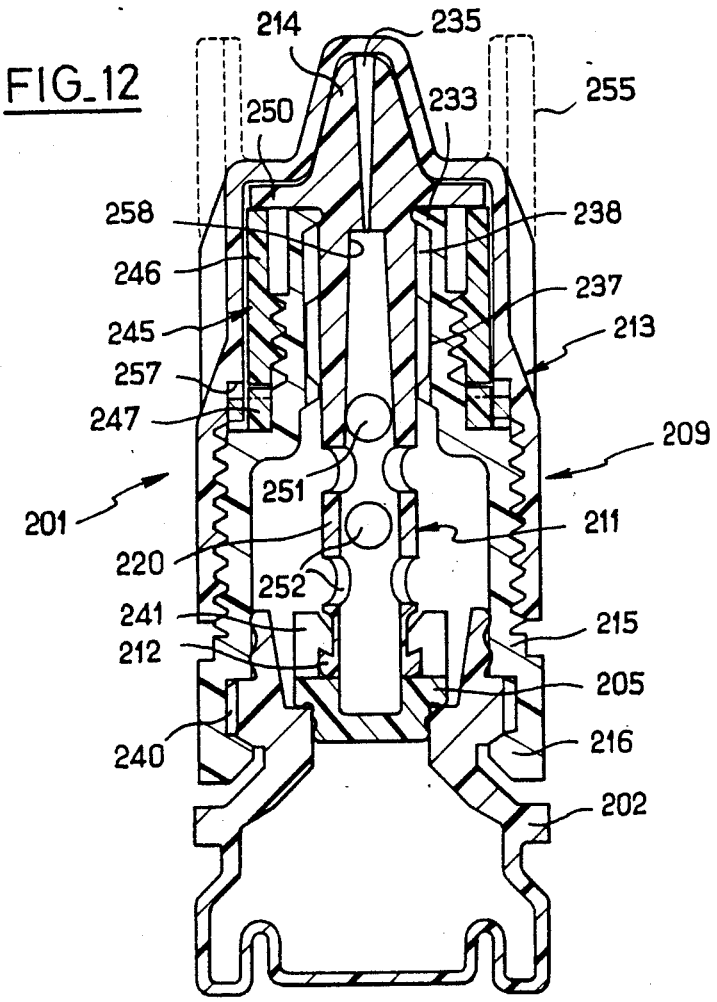

FIGS. 1 through 3 show the assembly of a packaging and dispensing system of a first embodiment of the invention, FIG. 3 showing the product ready for use.

The packaging and dispensing system shown in FIG. 3 comprises a first bottle 2 containing the first ingredient 3, which is a liquid or a solid, the neck 4 of said bottle being closed by a plug 5. The plug 5 has a special construction in the context of the invention, in the sense that it comprises a main plug part 6 featuring a central orifice 7 and a clip-on or snap-on obturator part 8 implementing the plugging function proper. This part 8 features an outwardly facing recess 8' whose shape is adapted to form a coupling with an internal coupling member carried by the second bottle as will be described hereinafter. The system comprises a second bottle 9 (the construction of which will be described in more detail later) containing the second, liquid ingredient 10. The second bottle is attached to the first bottle 2 at its neck.

The system 1 comprises an internal coupling member 11 carried by the second bottle 9, said member being of elongate shape and having an end 12 coupled to the plug 5 which closes off the first bottle 2, the coupling being effected automatically when fitting said first and second bottles together.

The system comprises a cap 13 screwed onto the second bottle 9, said cap being joined to the internal coupling member 11 in such a way that on first use unscrewing of said cap first displaces the plug 5 and so establishes automatically the communication between the first and second bottles 2 and 9 so that mixing can proceed in complete safety and without compromising sterile conditions, and subsequently uncovers the orifice in a dispensing nozzle 14 carried by said second bottle.

In the context of the first embodiment shown in FIGS. 1 through 5, the second bottle 9 of the packaging and dispensing system comprises a bellows-like main body 15 which has one end 16 adapted for fastening to the first bottle 12. The other end 17 has a screwthread 18 on the outside and carries the internal coupling member 11 on the inside. The coupling member 11 comprises in this instance a fixing ring 19 which is received into a groove inside the end 17 of the main body 15, said ring being extended by a rod 20 the end 12 of which provides the coupling to the plug 5. The shapes of the end 12 of the coupling member and of the recess 8' in the plug 5, in combination with the resilience of said plug, are adapted to securing an automatic snap-action fastening on penetration of said end 12, in the manner of a harpoon.

The second bottle 9 further comprises a sleeve forming a cap 13 and surrounding the bellows-like main body 15. One end 21 of the sleeve 13 is rotatably mounted on the assembly end 16 of the bellows-like main body 15 while its other end has a screwthread 22 on the inside cooperating with the external screwthread 18 on the main body so that communication between the first and second bottles 2 and 9 is established automatically on rotating the sleeve 13 relative to said first bottle. It will be seen that the threaded end of the main body 15 is extended by a portion receiving the dispensing nozzle 14, said portion carrying a closing capsule 24, in this instance screwthreaded, this capsule being integrated into the end of the sleeve 13 until such time as communication has been established between the first and second bottles 2 and 9.

The sleeve 13 has in its central part at least one (in this instance two) lateral windows 24 enabling the bellows to be compressed during dispensing. It is advantageous for the end 21 of the sleeve 13, mounted on the assembly end 16 of the main body, to terminate in a protection ring 25 coupled to said assembly end. The presence of a centering ring 26 fastened to the rod 20 of the coupling member 11 will also be noted.

To obtain the packaging and dispensing system shown in FIG. 3, the procedure is as follows: the ingredient 3 (liquid, powder, freeze-dried ingredient) having been placed in the first bottle 2, this bottle is stoppered with the plug 5, as schematically shown in FIG. 1. The approriate quantity of the other ingredient 10, which is a liquid, is then placed in the second bottle 9 turned upside down with its dispensing nozzle facing downwards and its cap screwed on, as shown in FIG. 2; the first bottle 2 is then brought above the second bottle 9 and the two bottles are then fastened together, which automatically secures the coupling between the end 12 of the coupling member and the removable portion 8 of the plug 5. The packaging and dispensing system obtained in this way can be stored, each of the ingredients being safely confined in its own bottle. It should be noted that in the case of a freeze-dried ingredient the second bottle 2 will be made from glass, the flexibility needed for dispensing being achieved by flexible implementation of the bellows-like main body.

It is important to note that the packaged system as shown in FIG. 3 does not provide any access to the capsule 23, which is integrated into the screwcap.

At the time of first use, the sleeve forming the cap 13 is first turned in the normal unscrewing direction, the first effect of which is to break off the separation in the protection ring 25; then, by virtue of cooperation between the screwthreads 18 and 22, the end 17 of the main body moves upwards relative to the sleeve 13 as far as an abutment position. This movement automatically entrains the part 8 of the plug, and so establishes the communication between the two bottles, which enables the two ingredients to be mixed. It is only at this stage that the closure capsule 23 is accessible to the user, who need only unscrew this capsule to use the mixture. FIG. 5 is a schematic illustration of such use, after removal of the closure capsule 23.

Thus, with a packaging and dispensing system of this kind, it is impossible to use one of the two ingredients in the non-mixed state. Also, further use after screwing on the closure capsule 23 is possible only if this capsule is accessible: thus if the user should erroneously maneuver the cap 13 the capsule will no longer be accessible, with the result that it is impossible to re-partition the two chambers on subsequent use. Finally, the presence of a protection ring provides a visible record of the first opening of the system.

FIGS. 6 through 10 show a second embodiment of the packaging and dispensing system in accordance with the invention. In this embodiment the main body of the second bottle is no longer of the bellows type and the cap has a special construction in three separable parts.

For reasons of clarity, the component parts of the system in this second embodiment with counterparts in the previous embodiment carry the same reference numbers increased by 100.

Thus there are seen in FIG. 6 a first bottle 102 containing an ingredient 103 and the neck 104 of which is stoppered by a plug 105. Note that in this instance the plug 105 is in one piece and that its upper portion features a recess 108' (FIG. 7) for coupling to an internal coupling member, harpoon-fashion and as explained with reference to the previous embodiment. In this case the main body 115 is essentially cylindrical and its lower end 116 is adapted for assembly to the first bottle 102, while its other end carries a dispensing nozzle 114. Differing in this respect from the previous embodiment, the dispensing nozzle 114 is in the form of a hollow body which itself supports the coupling member 111. The dispensing nozzle 114 is received into the main body 115 by virtue of a splined coupling permitting telescopic motion of said nozzle: there are respective splines 137 and 138 externally on the nozzle 114 and internally on the main body 115. The dispensing nozzle 114 can thus be moved between a low position shown in FIG. 8 and a high position shown in FIGS. 9 and 10, in which position said nozzle is held by abutments 132 (abutment members) and 133 (a lip at the end of the main body 115). The coupling member 111 comprises a fixing ring 119 received into a groove or a bore inside the dispensing nozzle 114, said ring being extended as previously by a rod 120 the end 112 of which provides the coupling to the plug 105.

In the context of this second embodiment, the second bottle 109 comprises a cap 113 formed of three separable parts 127, 128 and 129. The part 127 is rotatably mounted on said body, with two intermediate ramps 130, 131 between said separable parts. The lower part 127 of the cap 113 is thus fixed to but can rotate on the main body 115. The parts 127 and 128 are separated by a ramp 130, while the parts 128 and 129 are separated by another ramp 131 in the opposite direction, the last separable part 129 featuring a threaded sleeve 136 which screws onto the dispensing end of the nozzle 114 to close off the orifice 135 of the latter.

The system 101 is assembled in a similar way to the previous embodiment: first the required quantity of the ingredient 103 is placed in the first bottle 102 (FIG. 6), which is then stoppered in a fluid-tight manner with the plug 105. The required quantity of the other, liquid ingredient is then placed in the second bottle 109, while it is upside down with its dispensing nozzle facing downwards and its cap screwed on, as shown in FIG. 7. The first bottle 102 is then assembled to the second bottle 109 by simply clipping the end 116 of the body 115 onto the neck 104 of the first bottle 102, which simultaneously and automatically provides the coupling between the end 112 of the coupling member 111 and the plug 105.

At the time of use, the user unscrews the cap 113, holding its upper part 129. This unscrewing motion first leads to separation of the parts 127 and 128 and, because of the ramp 130, the remaining parts of the cap move upwards, entraining not only the dispensing nozzle 114 but also the coupling member 111 which removes the stopper and, by establishing the communication between the two bottles, makes it possible to mix the two ingredients. At the end of telescopic sliding movement of the nozzle 114, the latter is held between the abutments 132 and 133, so that continued unscrewing of the cap leads to separation of its parts 128 and 129. The part 128 then remains on the main body 115 whereas the last separable part 129 then constitutes an ordinary cap for the resulting assembly. The splined coupling between the nozzle and the main body means that unscrewing of the last part 129 makes it a simple matter to uncover the orifice 135 in the dispensing nozzle. Once the last separable part 129 has been removed, the packaging and dispensing system is in the condition shown in FIG. 9. Droplets may then be easily administered, for example by manual compression of the main body 115, as shown in FIG. 10. When the user screws on the separable part 129 forming a cap, the effect of the upper ramp 131 is to push down the intermediate part 128 if still in the high position, so preventing any further downward telescopic movement of the dispensing nozzle 114. This ensures that it is impossible to re-partition the two chambers after the system has been opened.

As compared with the previous embodiment, this second embodiment 101 has the advantages of greater simplicity and a reduced number of parts. Also, the user has only one member to maneuver (the upper part 129 of the screwcap). The further embodiments of the invention that are now to be described concern packaging and dispensing systems in which the second bottle comprises on the one hand a main body of which one end receives by virtue of telescopic sliding movement a member constituting both the internal coupling member and the dispensing nozzle and, on the other hand, a cap screwed onto the main body and comprising a direct or indirect drive linkage with the sliding part: thus, in the context of such embodiments, unscrewing of the cap results automatically in displacement of the single sliding part to establish the communication between the first and second bottles before uncovering the orifice in the dispensing nozzle, the structure being such that screwing the cap on again cannot result in reverse displacement of said sliding part.

FIGS. 11 through 14 show a third embodiment of the invention, with a packaging and dispensing system comprising an intermediate bush providing a rotational drive linkage and a sliding part providing both the coupling to the plug and the dispensing nozzle.

Thus there are seen in FIGS. 11 and 12 a first bottle 202, in this instance with external splines 240 on its neck, said bottle being stoppered in a fluid-tight way by a plug 205 which is in this instance surmounted by four hook-shape members 241 for coupling it to the sliding member 211 which forms, as explained above, both the coupling member for the coupling to the plug and the dispensing nozzle. The main body 215 receives the sliding member 211 by virtue of a splined coupling permitting telescopic motion, in a similar way to the coupling provided in the previously shown embodiment: there are thus external splines 237 on the sliding member 211 and internal splines 238 on the main body 215. Upward movement of the sliding member 211 is limited by the inwardly projecting rim 233 at the end of the main body 215. The sliding member 211 further features a radial flange 250 external to the main body 215 and surmounted by the dispensing nozzle 214.

Figure 13:
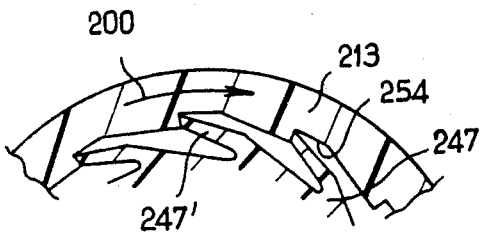
FIG. 13 shows a detail of FIG. 12 in cross-section, showing the snap-action interaction between the cap and the bush, the arrow showing the direction for unscrewing the cap.
Figure 14:
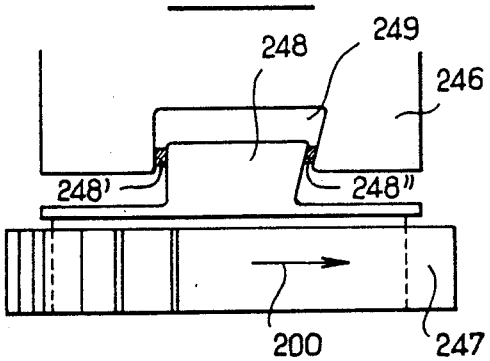
FIG. 14 is a partial view showing the base of the intermediate bush in two parts (not yet separated) used in the system shown in FIGS. 11 and 12.

In this third embodiment there is provision for disposing an intermediate bush 245 around the end of the main body 215 and adjacent the radial flange 250 on the sliding member 211. This intermediate bush 245 is designed to be entrained directly by the cap 213 when the latter is unscrewed, in order to serve as a lifting device procuring upward movement of the sliding member 211. As seen from FIGS. 11, 12 and 14, the intermediate bush 245 is in two separate parts 246, 247: the part 247 is a snap-action ring which is smooth on the inside and the part 246 is a sleeve which is threaded on the inside, said parts being constrained to rotate together when in contact with each other. This is achieved by cooperation between projections 248 on the ring 247 and corresponding notches 249 in the sleeve 246. In practise, as shown in FIG. 14, the bush 245 may be made by injection molding, after which the two portions 246 and 247 are joined at only two points 248' and 248", which linkages are broken at assembly time when the bush is compressed longitudinally. The snap-action ring 247 has teeth 247' cooperating with corresponding notches 254 on the inside of the cap 213: it should be noted that the entrainment is effective in the direction of unscrewing the cap 213, which direction is shown by the arrow 200 in FIG. 13 and 14 showing the details concerned.

Thus the main body 215 has two essentially coaxial screwthreads 243, 244 on its outside, respectively cooperating with an internal thread 253 on the cap 213 and an internal thread 256 on the intermediate bush 245. The presence of a shoulder 257 inside the cap 213, adjacent to the splined area 254 which cooperates with the snap-action ring 247, should also be noted. This shoulder is an additional safety feature to ensure separation of the snap-action ring 247 from the sleeve 246 when the cap 213 is screwed on again.

Finally, the sliding member 211 has, running from the side of the radial flange 250 opposite the dispensing nozzle, a tubular part 220 whose end 212 provides the coupling to the plug 205, said part preferably comprising radial perforations 252 to increase its elasticity in the longitudinal direction. This spring effect is particularly beneficial for ensuring a good seal in the axial direction at the plug 205. The tubular part 220 also comprises a radial orifice 251 for the liquid to pass through towards the orifice in the end of the nozzle. It will be noted in particular that the sliding member 211 features a slightly conical bore 258 to ensure that no drops of liquid can be held back by capillary action and thus escape mixing, any such drop always falling back to ensure correct mixing of the two ingredients. It should also be noted that the splines 237, 238 form a sliding seal so that raising of the sliding member 211 on unplugging causes a drop in pressure which increases the internal volume of the chamber, this drop in pressure causing air to enter through the orifice and contributing also to the expelling of any droplet that may be retained in the central bore of said sliding member.

To assemble the packaging and dispensing system 201, the first stage is to pre-assemble the second bottle 209: thus the main body 215, the intermediate bush 245, the sliding member 211 and the cap 213 are fitted together. It should be noted that during screwing on of the cap 213 the snap-action coupling functions like a freewheel and therefore does not interfere at all with the complete screwing on of said cap, so ensuring that the orifice 235 of the dispensing nozzle 214 is correctly plugged and that the flange 250 on the sliding member bears correctly against the rim 233 on the main body 215 to obtain a perfect seal. The assembly process is thereafter comparable in all respects with that already described for the previous embodiments: first the required quantity of one ingredient is placed in the first bottle 202 which is then plugged with a plug 205 shaped to enable subsequent coupling (in this instance, this plug will preferably be made of polyethylene or polypropylene); the required quantity of the other, liquid ingredient is then placed in the second bottle 209 held upside down with its dispensing nozzle facing downwards and its cap screwed on; finally, the bottles 202 and 209 are fitted together, which automatically brings about the coupling to the plug 205 within the system by virtue of snap-action engagement between the end 212 and the hooks 241 on the plug 205.

Figure 15A:
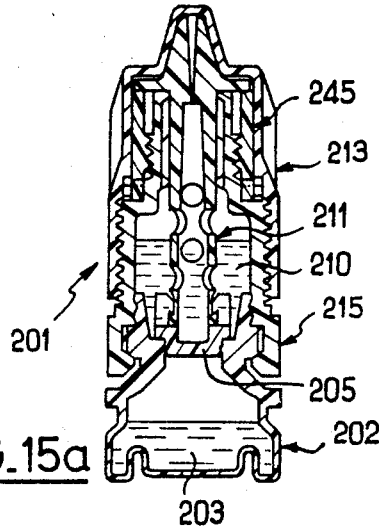
FIGS. 15*a* through 15*e* respectively show the packaging and dispensing system of FIGS. 11 and 12 ready for use, during mixing, at the time of opening, in use and reclosed after use.

FIGS. 15*a* through 15*e* explain how a packaging and dispensing system of this kind is used:

FIG. 15*a*: the system 201 is ready for use, meaning that the ingredients 203 and 210 are each stored in their respective chamber, a perfect seal being provided by the plug 205 and by the splines 240 on the first bottle 202.

Figure 15B:
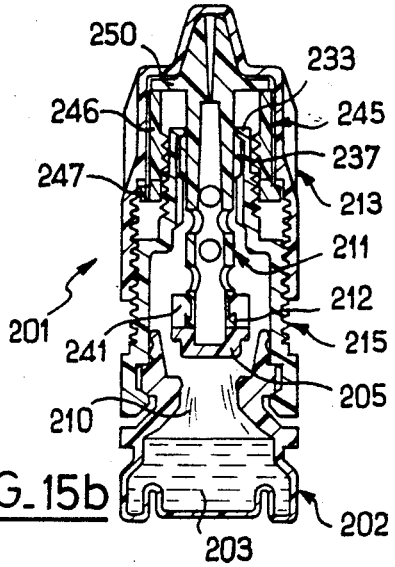

FIG. 15*b*: the user begins to unscrew the cap 213, which entrains with it the ring 247 and the sleeve 246; the intermediate bush 245 is therefore also entrained with an unscrewing motion (the screwthreads 243, 244 on the main body are preferably identical to avoid any jamming at this stage). The intermediate bush 245 thus pushes up the flange 250, entraining in its telescopic motion the sliding member 211 and therefore the plug 205: the communication between the two bottles is thus established and the mixing may proceed correctly.

Figure 15C:
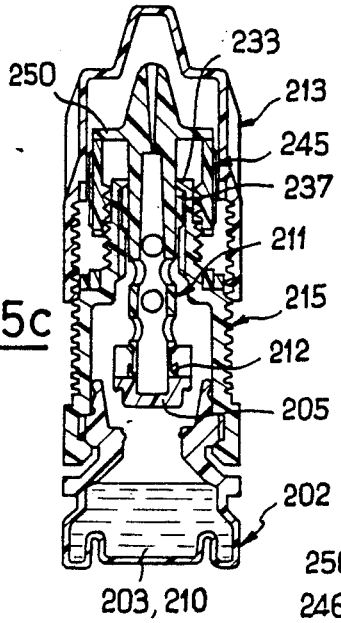

FIG. 15*c*: the intermediate bush 245 reaches an unthreaded part of the main body 215 and the sliding member 211 abuts at the top end of its travel against the rim 233: the cap 213 therefore continues to move on its own as unscrewing proceeds and the ring 247 will usually drop down to rest on the main body 215.

Figure 15D:
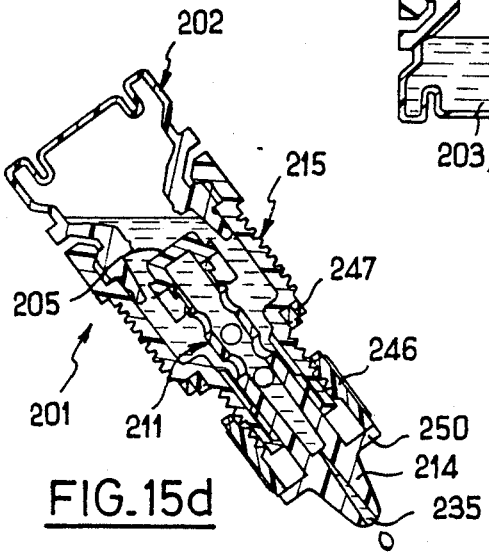

FIG. 15*d*: once the screwcap 213 has been removed the system is open and ready for use, either by compressing the main body laterally or by pressing on the bottom of the first bottle 202.

Figure 15E:
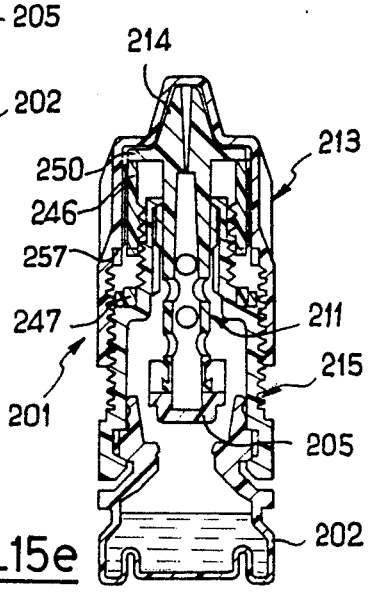

FIG. 15*e*: the user then screws the screwcap 213 back on: the shoulder 257 on said cap is then certain to push down the ring 247, if this has not fallen down previously, which prevents any possible subsequent coupling between the thus separated bush and the screwcap, so that said cap serves in future as an ordinary cap, without any risk of re-partitioning the two chambers of the system 201. What is more, further teeth could be provided on the upper edge of the sleeve 246 and on the lower edge facing it of the flange 250 to enable relative rotation movement only in the unscrewing direction (such teeth have not been shown here to avoid overcomplicating the figures).

It should be noted that in the storage position (FIG. 15*a*) the sliding member 211 forming a "harpoon" serves to retain the plug by exerting a constant closing force, which enhances the seal between the two bottles, and in particular prevents the plug 205 moving and accidentally establishing premature communication between the two chambers due to any impact or to any difference in pressure between the two chambers. Also, and as previously, if the packaging and dispensing system has been assembled under sterile conditions, the mixing operation is achieved without compromising such sterile conditions.

Figure 16:
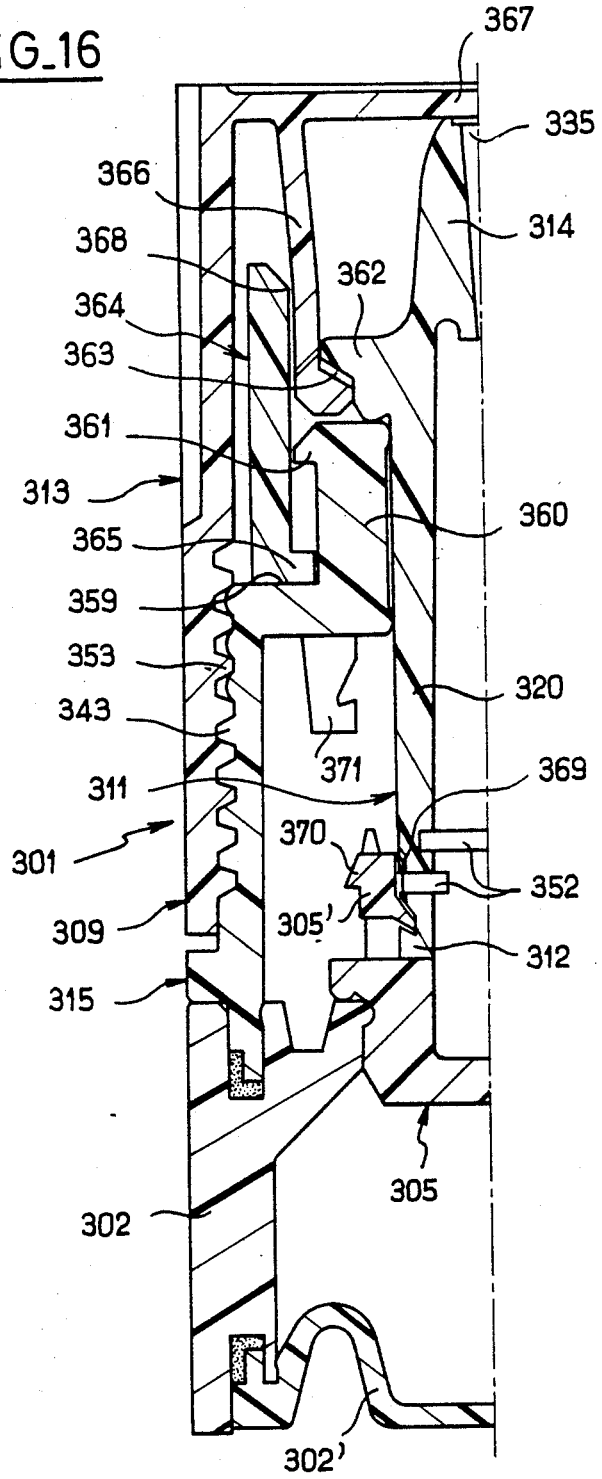
FIG. 16 is a half-view in axial cross-section showing a fourth embodiment of the invention, the packaging and dispensing system comprising a sliding latch and a cap with resilient drive and locking lugs.

FIG. 16 shows a fourth embodiment of the invention, with a packaging and dispensing system 301 comprising a sliding latch and a cap with resilient drive and locking lugs. As will be explained subsequently, an embodiment of this kind can be adapted to permit extraction of the closure plug by turning it.

A first bottle 302 is welded to a main body 315. The bottom 302' may likewise be welded to the side wall of said bottle. The main body 315 receives a sliding member 311 through a coupling enabling free telescopic movement in rotation and in translation, differing in this from the previous embodiments in which a splined coupling was provided. Thus the main body 315 has a single external screwthread 343 cooperating with the internal thread 353 on a screwcap 313. Beyond this is a shoulder 359 surmounted by a portion forming a smooth sleeve 360 which terminates in a projecting rim 361.

Below the dispensing nozzle 314 the sliding member 311 features a shoulder 362 provided with external splines 363. The main body 315 also carries a latch 364 in the form of a sliding sleeve which can move longitudinally over a predetermined distance. The latch 364 is preferably a smooth sleeve and features an internal shoulder 365 adapted to cooperate with the projecting rim 361 on the main body 315 in the position in which said latch is extended to the maximum extent.

The screwcap 313 has resilient lugs 366 (of which there are four, in a tulip-like configuration), these lugs passing being inserted (while prestressed in bending) between the latch 364 and the shoulder 362 on the sliding member 311. The free end of each resilient lug 366 is toothed to cooperate with the splines 363 on the shoulder, so creating a rotational coupling (which is temporary, as will be explained later) between the screwcap 313 and the sliding member 311. The sliding member 311 is extended at the lower end by a tubular part 320 whose end 312 provides the coupling to the plug 305, said tubular part comprising, as previously, radial perforations 352 to increase its elasticity in the longitudinal direction.

In the ready for use condition shown in FIG. 16, the orifice 335 in the dispensing nozzle 314 is closed off by the top 367 of the screwcap 313. When the user begins to unscrew the cap 313 the coupling through the resilient lugs 366 causes the sliding member 313 to turn also, provided that the latch 264 continues to hold said lugs prestressed in bending. Because of this, the upward movement of the cap 313 is accompanied by simultaneous upward movement of the latch 364 and of the sliding member 311 forming a "harpoon": as previously, the upward movement of the sliding member 311 unstops the first bottle 312 and establishes the communication between the two chambers for correct mixing of the two ingredients. At the end of an initial travel the latch butts up against the main body, when it contacts the rim 361 of said body: because of this, further unscrewing of the cap 313 gradually releases the resilient lugs 366 from the latch until the ends of said lugs pass beyond the edge 368 which defines the latching limit and the end of the second travel. Immediately the resilient lugs 366 are released from the latch 364, they move apart of their own accord because of their inherent elasticity, which prevents any subsequent insertion of said lugs between the latch and the sliding member when the cap is screwed on again. Nevertheless, it is preferable to provide also a direct latching action between the sliding member 311 and the main body 315 in order to prevent with absolute certainty any subsequent downward movement of the plug 305: this is achieved by providing coupling means 370, 371 between the main body and the plug, said means operating automatically in the position with the sliding member 311 extended to the maximum extent. Thus there is seen in FIG. 16 an extension 305' of the plug 305 with external projections 370 that can cooperate with a plurality of hooks 371 formed on the main body 315.

Figure 17:
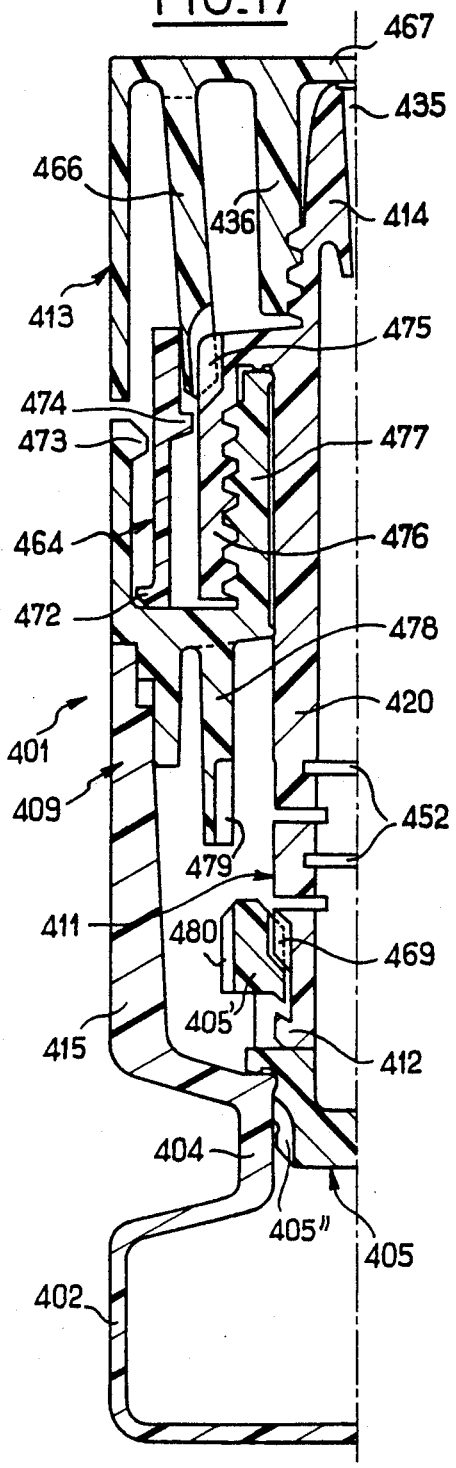
FIGS. 17 and 18 are half-views in axial cross-section showing a fifth embodiment of the invention, the packaging and dispensing system comprising a sliding latch, a cap with resilient drive and locking lugs and a coupling to the plug for improved extraction of the latter, the difference between the two figures relating to the material of the lower bottle, which is of glass in FIG. 18 whereas in FIG. 17 the bottle is a part of the plastics material body.
Figure 18:
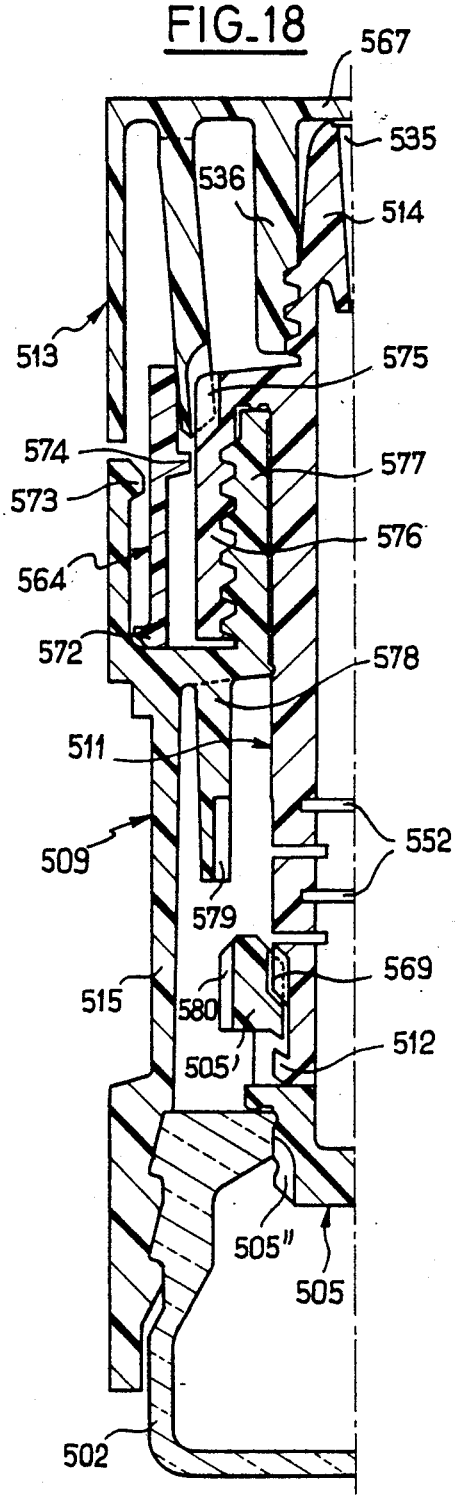

It is also beneficial to have the coupling between the end of the sliding member 311 and the plug 305 also provide for rotational locking, preferably by cooperation between splines and grooves 369, so that said plug can be extracted by turning on unscrewing the cap 313. FIGS. 17 and 18 show a fifth embodiment of the invention differing slightly from the previous embodiment. The only significant difference between the packaging and dispensing systems 401 of FIG. 17 and 501 of FIG. 18 is essentially concerned with the fact that, in the case of the system 401, the lower part of the main body 415 itself constitues the first bottle 402, the neck of said bottle being defined by a constriction 404 of said body, whereas the bottle 502 of the system 501 is a glass bottle. The following description will therefore be limited to the system shown in FIG. 17, the system of FIG. 18 comprising analogous component parts with reference numbers in the 500 range.

The main body 415 of the system 401 receives the sliding member 411 through a screw coupling, said sliding member having a coaxial sleeve 476 threaded internally and cooperating with the externally threaded end 477 of said body. The main body may naturally be made in two separate parts by injection molding with said parts then welded together. The main body 415 also carries a latch 464 in the form of a sliding sleeve that can move longitudinally over a predetermined travel. The latch 464 is similar to the latch of the previous embodiment, except that its structure is slightly modified to allow for the screw coupling between the main body 415 and the sliding member 411. Thus the latch 464 is a smooth sleeve having on the inside a first latching shoulder 474 and on the outside a second abutment shoulder 472 adapted to cooperate with a projecting rim 473 on the main body 415 in the position with said latch extended to the maximum extent. The presence on the edge of the coaxial sleeve 476 of splines 475 adapted to cooperate with the toothed ends of resilient lugs 466 analogous to the resilient lugs provided in the embodiment previously described will also be noted. The screwcap 413 has lugs 466 inserted, while prestressed in bending, between the latch 464 and the edge of the sleeve 476 of the sliding member 411. The screwcap 413 also has, projecting from its top 467, an internally threaded tubular portion 466 which screws on to the dispensing nozzle 414.

As previously, the coupling between the end of the sliding member 411 and the plug 405 also provides rotational locking, preferably by virtue of cooperation between splines and grooves 469, so that said plug can be extracted by turning on unscrewing the cap 413.

Figure 20:
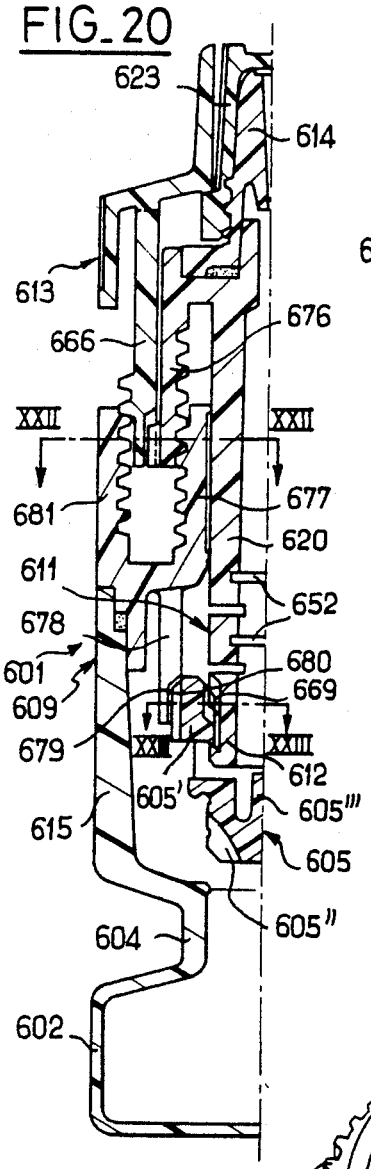
FIGS. 20 and 21 are half-views in axial cross-section showing a sixth embodiment of the invention, the packaging and dispensing system resembling that of FIGS. 17 and 18 but without any sliding latch and with a double screwthread on the resilient lugs of the screwcap, the plug being once again extracted by rotation and the lower bottle in FIG. 1 being of glass, whereas in FIG. 20 it is a part of the plastics material body.
Figure 23:
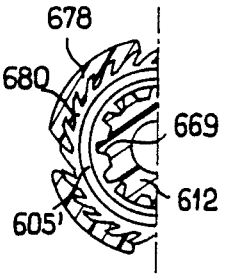
Figure 21:
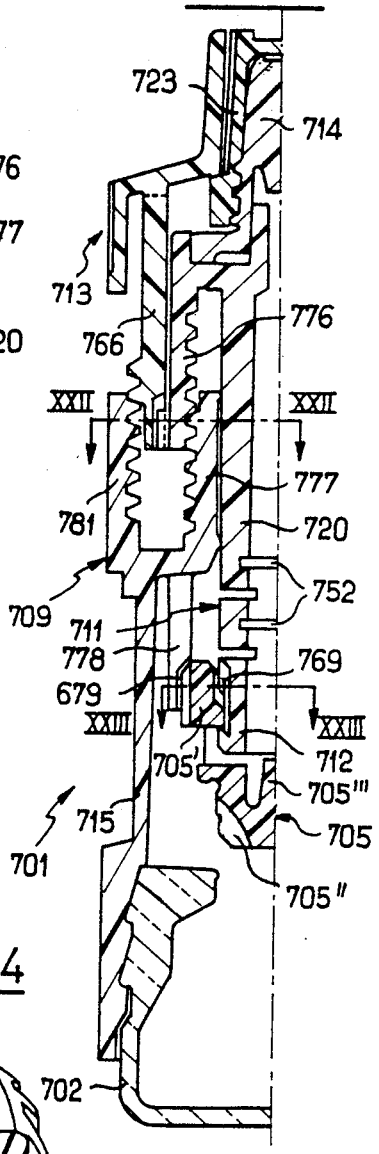
Figure 24:
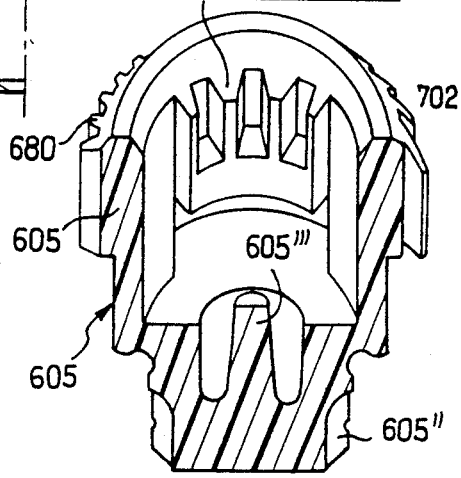
FIG. 24 is a half-view in perspective showing the construction of the plug in the fifth and sixth embodiment systems, with double rotational coupling.

Differing in this from the previous embodiment with snap-action hooks, the system 401 comprises additional rotational coupling means 479, 480 operating automatically in the position with the sliding member 411 extended to the maximum extent to enable normal unscrewing of the cap in use; these additional rotational coupling means comprise on the one hand longitudinal resilient lugs 478 attached to the main body 415 with their end toothed on the inside and, on the other hand, snap-action teeth 480 provided at the periphery of the plug 405, said means securing coupling between said body and said plug only in the direction of unscrewing the cap 413 (this snap-action mode will be described subsequently with reference to FIGS. 23 and 24 corresponding to the systems 601 and 701 of FIGS. 20 and 21).

As previously, the sliding member 411 features, running from its sleeve 476 on the side opposite the dispensing nozzle 414, a tubular part 420 whose end 412 provides the coupling to the plug 405, said part comprising radial perforations 452 to increase its elasticity in the longitudinal direction.

The advantageous presence of fins 405" in the lower part of the cap 405 to facilitate the passage of water vapor in the case of a freeze-dried ingredient will also be noted.

FIGS. 19*a* through 19*f* show the various stages of use of the packaging and dispensing system 401 from FIG. 17, as briefly described hereinbelow.

Figure 19C:
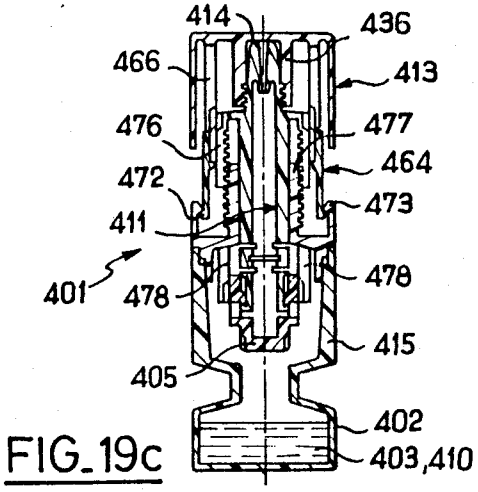
FIGS. 19*a* through 19*f* show the packaging and dispensing system from FIG. 17 ready for use, during mixing (before and after disengagement of the resilient lugs from the cap), after removal of the cap for opening, in use and reclosed after use.
Figure 19F:
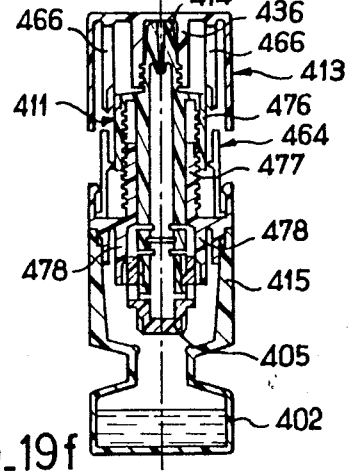
Figure 19B:
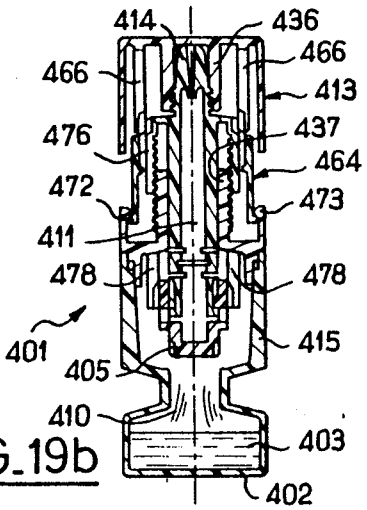
Figure 19E:
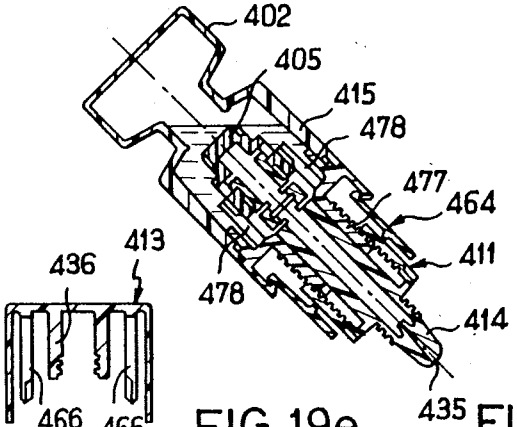
Figure 19A:
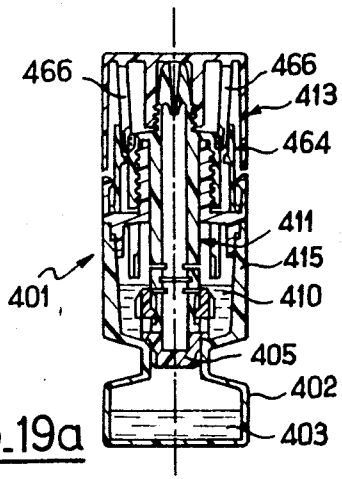

FIG. 19*a*: the system 401 is in the ready for use condition shown in detail in FIG. 17. In this condition, each of the ingredients 403 and 410 is stored in its respective bottle, the plug 405, on which the member 411 forming a "harpoon" presses, providing a perfect seal between the two chambers.

FIG. 19*b*: when the user begins to unscrew the cap 413, it entrains in the upward direction the member 411 together with the latch 464, until the latter is stopped at the upper end of its movement by contact with the rims 472, 473. Subsequent unscrewing eventually frees the ends of the resilient lugs 466 from the latch 464, so eliminating the rotational drive coupling to the member 411. As previously, the upward movement of the member 411 has drawn the plug 405 with it and so established the communication between the two chambers for mixing of the two ingredients.

FIG. 19*c*: the resilient lugs are now free of the latch 464 and have returned to their natural position. Also, the coupling at the lower part of the member 411 is already operative due to the action of the resilient lugs 478, so that it is not possible to screw the member 411 down again.

Figure 19D:
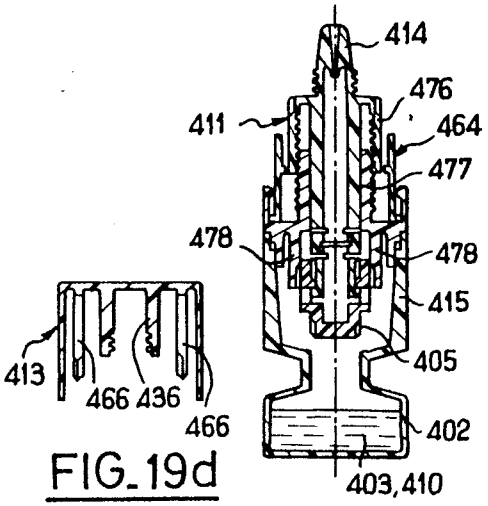

FIG. 19*d* the cap 413 is now totally unscrewed, providing access to the dispensing nozzle 414. In theory, the latch 464 has dropped down due to its own weight: in any event, it can no longer be operative once the cap 413 has been unscrewed for the first use.

FIG. 19*e*: the system is used to dispense droplets of the mixture through the orifice 435, either by pressing on the side walls of the main body 415 or by pressing on the bottom of the part of said body forming the bottle 401.

FIG. 19*f*: the user then screws the cap 413 back onto the nozzle 414: at the end of its travel, the torque exerted on it can no longer screw down the member 411 because of the coupling provided by the resilient lugs 478, so that the communication between the two chambers is continuously established from this time onwards.

FIGS. 20 and 21 show a sixth embodiment of the invention, with a packaging and dispensing system similar to those of FIGS. 17 and 18 but without any sliding latch and with a double screwthread on the resilient lugs of the screwcap. As in the preceding embodiments, means are advantageously provided to enable the plug to be extracted by turning.

As in FIGS. 17 and 18, the packaging and dispensing systems 601 and 701 of FIGS. 20 and 21 differ only in terms of the structure of the bottle 602, 702: for the system 601 the lower part of the main body 615 itself constitutes the first bottle 602, the neck of said bottle being defined by a constriction 604 of said body, whereas the bottle 702 of the system 701 is separate and made of glass. As the other component parts are identical, the description will be limited to the system 601, corresponding component parts of the system 701 having reference numbers in the 700 range.

The main body 615 receives the sliding member 611 through a screw coupling, said sliding member featuring an internally threaded coaxial sleeve 676 cooperating with an externally threaded first end 677 of said body, which has an internally threaded second end 681 facing towards said first end and cooperating with the resilient lugs 666 of a cap 613 which are externally threaded. In this embodiment the function of the latch in the previous embodiment is thus implemented by the main body itself.

Figure 22:
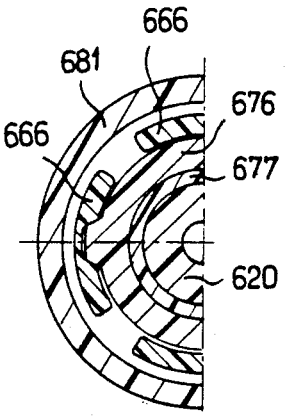
FIGS. 22 and 23 are respectively cross-sections on the lines XXII—XXII and XXIII—XXIII in FIGS. 20 and 21 showing the respective rotational couplings.

The resilient lugs 666 of the screwcap 613 surround the sleeve 676 of the sliding member 611 and hold the capsule 623 associated with the dispensing nozzle 614 for as long as its thread is engaged with that on the main body 615, after which said cap can be disposed of and said capsule serves as an ordinary cap. The screwcap 613 and the sliding member 611 are rotationally coupled, preferably by cooperation of splines and grooves, for as long as the thread on said cap is meshed with that on the main body 615. FIG. 22 is a cross-section showing the rotational coupling between the resilient lugs 666 and the threaded sleeve 676 of the sliding member 611.

In the lower part of the sliding member 611 forming a "harpoon" there is a rotational coupling similar to that already described for the systems 401 and 501 of FIGS. 17 and 18. Thus there is a coupling between the end 612 of the sliding member and the plug 605 which also secures rotational locking, preferably as a result of cooperation between splines and grooves, so that the plug can be withdrawn by turning on unscrewing the cap 613. There are also additional rotational coupling means between the main body 615 and the plug 605, said means operating automatically in the position with the sliding member 611 extended to the maximum extent to enable normal unscrewing of the capsule 623 in use: these additional rotational coupling means comprise on the one hand longitudinal resilient lugs 678 attached to the main body 615 with the end toothed internally and, on the other hand, snap-action teeth 680 formed at the periphery of the plug 605, said means providing a coupling only in the direction of unscrewing the cap 613 or the capsule 623. These couplings are seen more clearly on referring to the cross-section in FIG. 23, where it is possible to distinguish between an internal coupling through cooperation between splines and grooves between the end 612 and the upper part 605' of the plug 605 and an external snap-action coupling between said plug and the resilient lugs 678 attached to the main body 615.

For a better understanding of the precise structure of the plug 605, reference should be had to FIG. 24 which shows clearly the internal splines 669 and the external snap-action teeth 680. There is also seen a central protuberance 605''' projecting axially upwards, this protruberance preventing any retention of isolated droplets in a dead area which could as a result be dispensed from the dispensing system in the non-mixed condition.

When the user begins to unscrew the cap 613 the sliding member 611 is entrained by cooperation between the resilient lugs 666 of said cap which continue to be held against the sleeve 676 by virtue of the thread on the end 681 of the main body. This unscrewing movement causes the sliding member 611 to move upwards and, as in the previous embodiments, raising and rotation of the plug 605, to establish the communication between the two bottle chambers and mixing of the two ingredients. It should be noted that during this partial unscrewing of the cap 613 the user does not as yet have any access to the screw capsule 623 which closes off the dispensing nozzle 614. As unscrewing of the cap 613 continues, the outside thread on the resilient lugs 666 is no longer meshed with that of the end 681 with the result that the cap 613 can slide upwards and so be disposed of. The user then has merely to maneuver the capsule 623 to use the mixture, just like an ordinary cap. It goes without saying that the snap-action coupling provided at the level of the plug prevents any subsequent screwing down of the sliding member 611 when the user screws the capsule 623 back on after use. The embodiments 601 and 701 have, compared with the embodiments previously described, the advantage of a low closing torque applied to the small diameter capsule 623; this significantly reduces the risk of the anti-unscrewing teeth being damaged. Also, the fact that the screwcap is disposable enables the user to shake the system for optimum mixing before opening for first use. Also, the sealing of the packaging and dispensing system is totally satisfactory in that, during storage, there are three seals between the sliding member 611 and the body 615 (two seals in the radial direction at the level of the outside wall of the tubular part 620 and one seal in the axial direction at the level of the top of the threaded end 677) and in that, during use, there are two seals, namely the two radial seals just mentioned.

As in the previous embodiments, the sliding member 611 has a tubular part 620 comprising radial perforations 652 to increase its elasticity in the longitudinal direction, so that it can contribute to obtaining a perfect seal within the system.

Figure 25:
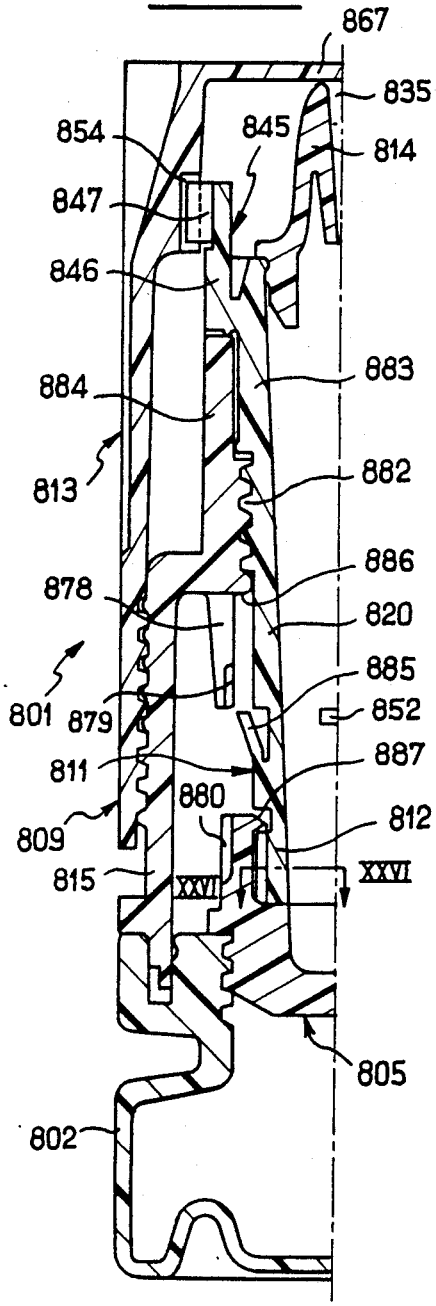
FIG. 25 is a half-view in axial cross-section showing a seventh embodiment of the invention, the packaging and dispensing system being suited to the use of a screwcap and comprising a bush with a disposable snap-action ring to prevent the plug being screwed back in on closing after use.

FIG. 25 shows a seventh embodiment of the invention, with a packaging and dispensing system 801 suited to the use of a screwed plug and comprising a bush with a disposable snap-action ring to prevent the plug being screwed in again on reclosing after use.

Thus the second bottle 809 comprises a main body 815 of which one end can be assembled to the first bottle 802 and the other end receives the coupling member 811 by virtue of a screw coupling. Unlike the previous screw coupling embodiments, in this instance the coupling member 811 comprises an externally threaded central part 882 extended by an externally smooth part 883 closed off by a dispensing nozzle 814, which in this instance is not integral with it. The main body 815 comprises an upper extension 884 with a threaded lower part and a smooth upper part in corresponding relationship.

Figure 27:
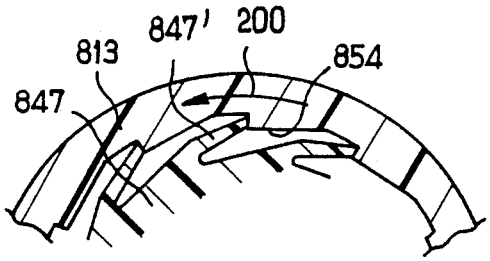
FIG. 27 is analogous to FIG. 13 and shows the snap-action interaction of the cap and bush in the system shown in FIG. 25, the arrow showing the direction for unscrewing the cap.
Figure 28:
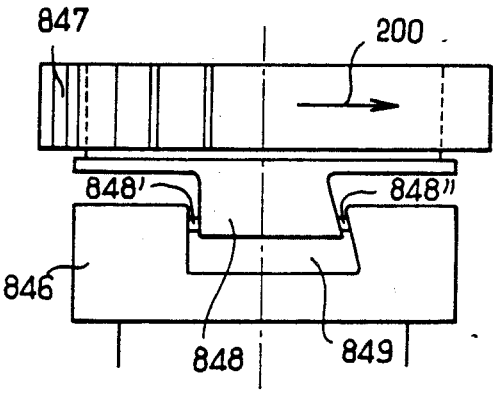
FIG. 28 is analogous to FIG. 14 and shows the two parts of the previously mentioned intermediate bush, where in this instance the upper part is disposable.

The cap 813 screwed onto the main body 815 comprises a rotational drive linkage with an intermediate bush 845 extending the coupling member 811. In the same way as the intermediate bush 245 previously described with reference to FIGS. 11, 12 and 14, the intermediate bush 845 is in two separate parts, the first being a drive ring 846 attached to the coupling member 811 and the second being a snap-action ring 847: the parts 846 and 847 are constrained to rotate together when they are in contact with each other, that is to say until the cap 813 is unscrewed for the first use, after which said snap-action ring is disposable. This rotational drive coupling is such that unscrewing the cap 813 automatically displaces the coupling member 811 to establish the communication between the first and second bottles 802, 809 before uncovering the orifice 835 in the dispensing nozzle 814. FIG. 28, which is analogous to FIG. 14, shows the intermediate bush as made by injection molding, with fragile linking points 848' and 848" which are broken when the system is assembled; there is also a protuberance 848 inserted into a corresponding recess 849, the arrow 200 showing the unscrewing direction. FIG. 27, which is analogous to FIG. 13, likewise illustrates the snap-action coupling between the grooves 854 on the screwcap 813 and the teeth 847' on the aforementioned snap-action ring 847.

Figure 26:
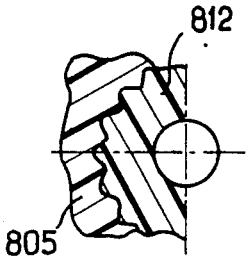
FIG. 26 is a cross-section on the line XXVI—XXVI in FIG. 25 showing the coupling at the level of the plug.

Differing in this respect from the previous embodiments, the plug 805 is here screwed onto the first bottle 852. Because of this, it is necessary to provide a coupling between the end 812 of the coupling member 811 and the plug 805, which coupling also secures rotational locking, preferably as a result of cooperation between splines and grooves, so that said plug can be unplugged on unscrewing the cap 813: the detail cross-section in FIG. 26 shows a spline and groove coupling of this kind. The plug 805 also features an internally projecting rim 887 which holds the plug once the latter has been withdrawn from the corresponding thread on the bottle 802.

As previously, additional rotational coupling means are provided between the main body 815 and the plug 805, said means operating automatically in the position in which the coupling member 811 is extended to the maximum extent. These additional means comprise on the one hand longitudinal resilient lugs 878 attached to the main body 815 and internally toothed at the end and, on the other hand, snap-action teeth 880 provided at the periphery of the plug 805, said means being operative only in the direction of unscrewing the cap 813. For a perfect understanding of these additional rotational coupling means reference should be had to FIG. 23.

When the user begins to unscrew the cap 813 the coupling member 811 is simultaneously entrained in rotation because of the intermediate bush 845. At the end of an initial travel, the bore 882 on the coupling member 811 reaches the smooth part of the extension 884 of the main body 815: as a result, the upward movement of the coupling member 811 ceases, whereas that of the cap 813 continues. In this position the threaded plug 805 has been unscrewed and communication between the two chambers has been established for mixing of the two ingredients. A projecting lug 885 may be provided on the tubular portion 820 of the coupling member 811 to provide an abutment member in the raised position, bearing against a shoulder 886 on the main body 815. In the upper part the teeth 879 on the lugs 878 and the teeth 880 on the plug 805 are engaged with each other, preventing the coupling member 811 being screwed in again at the time of subsequent replugging. Eventually the cap 813 is detached from the rest of the system, with the result that the snap-action ring 847 may be disposed of, preventing any possible entrainment in rotation during subsequent screwing or unscrewing of the cap 813.

Figure 29:
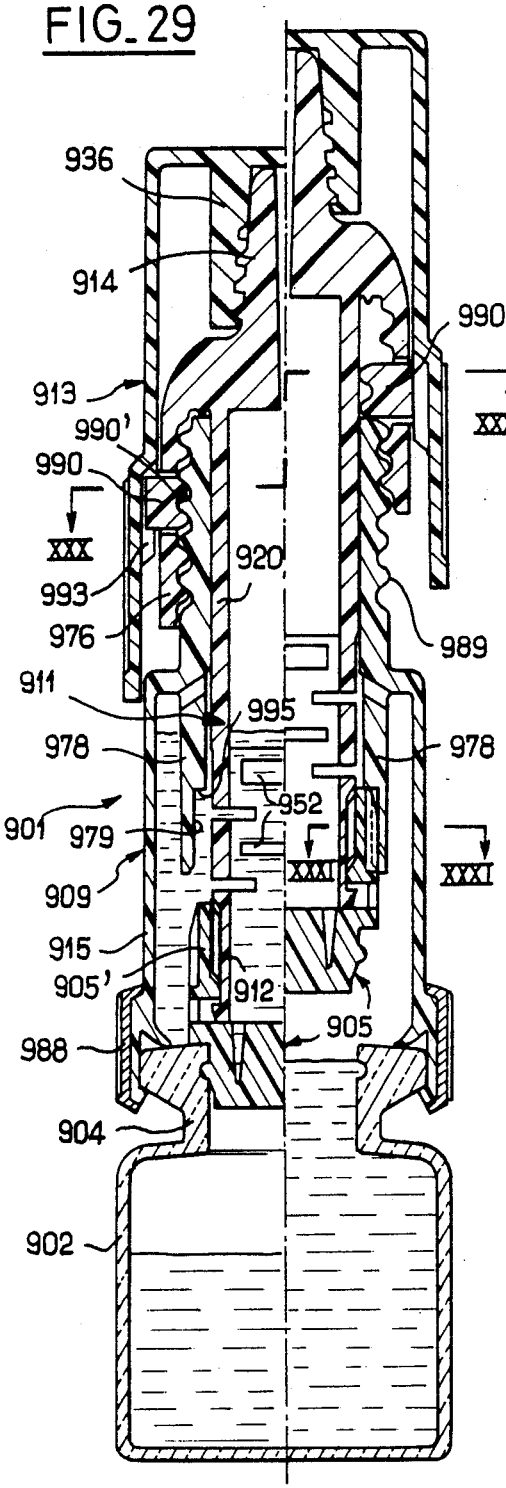
FIG. 29 is an axial cross-section showing an eighth embodiment of the invention (the lefthand half-section corresponds to the packaging and the righthand half-section corresponds to the opening of the system, the cap being unscrewed from the main body of said system), the packaging and dispensing system comprising a sliding member with retractable spring lugs onto which the cap screws.
Figure 30:
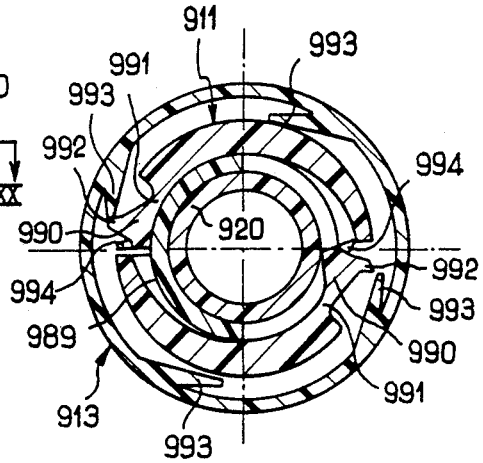
FIG. 30 is a cross-section on the line XXX—XXX in FIG. 29 showing the snap-fastener connection between the lugs on the sliding member and the screwcap for two different unscrewing positions of said cap.
Figure 31:
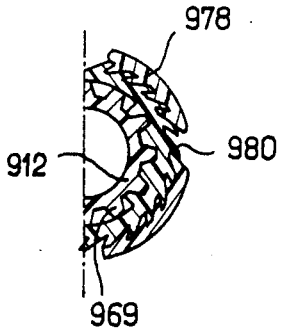
FIG. 31 is a cross-section on the line XXXI—XXXI in FIG. 29 analogous to FIG. 23.

FIGS. 29 through 31 show an eighth embodiment of the invention with a packaging and dispensing system 901 resembling that 601 of FIGS. 20, 22 and 23 except that it incorporates a sliding member with retractable spring lugs cooperating with the screwcap.

As previously the system 901 comprises a first bottle 902 with a neck 904 closed by a plug 905 and a second bottle 909 assembled to the first bottle 902 at the neck of the latter (note in this instance, however, the presence of a clamping ring 988 made from aluminum, for example). The second bottle 909 comprises a main body 915 receiving telescope-fashion a sliding member 911 simultaneously forming the interior member of the coupling and the dispensing nozzle.

In this instance, however, the sliding member 911 is screwed by means of an internally screwthreaded sleeve 976 onto the upper end 989 of the main body, which is screwthreaded externally, and the sleeve 976 comprises at least one (in this instance two) retractable spring lugs 990 which can "give" in the transverse direction.

The two lugs 990 are joined to the sleeve proper by a ligament 991 forming a hinge and are made in such a way that their natural position is a position corresponding to the lefthand half-section in FIGS. 29 and 30. Each of the two lugs 990 has on its inside a screwthread 990' complementary to that of the sleeve (the screwthread 990' shown here therefore comprises two separate threads) and on the outside a peg 992 adapted to cooperate with internal teeth 993 (seen more clearly in FIG. 30) on the cap 913 which in this instance screws onto the sliding member 911: this makes it possible to define a snap-fastener connection between the screwcap 913 and the sliding member 911 which remains effective for as long as the screwthread 990' of each spring lug 990 is engaged with that of the end 989 of the main body 915.

At the time of first use, the user begins to unscrew the cap 913 which because of the aforementioned snap-fastener linkage entrains the sliding member 911 and so establishes communication between the two bottles.

Immediately the lugs 990 reach the upper edge of the main body 915 they retract because of the force exerted on them by the associated peg 992, which has two consequences: one is that the snap-fastener linkage between the cap and the sliding member is broken, so that subsequent screwing on of said cap cannot cause any retrograde movement of said sliding member, and the other is that this retracted position of the spring lugs simultaneously defines an abutment for axial movement in translation also preventing any retrograde movement of the sliding member.

It is beneficial for each retractable spring lug 990 to have a projecting point 994 at the end. This point constitutes an additional safety feature designed to prevent "rescrewing" of the cap 913: when the lugs 990 are moved to their retracted position each of the points 994 cooperates with the adjacent interior screwthread on the sleeve 976 (as seen in the righthand half-section in FIG. 30) to lock the associated spring lug into its retracted position. This significantly improves the reliability of the axial translation abutment preventing any new movement of the sliding member 911 inwardly relative to the main body 915.

In the lower part of the sliding member 911 is an arrangement analogous to that already described for the system 601 with reference to FIGS. 20 and 23.

There is therefore a rotational coupling by virtue of cooperation between splines and grooves between the end 912 of the sliding member 911 and the upper part 905' of the plug 905 (the so-called internal coupling). There is also an additional rotational coupling between the plug 905 and the main body 915, in more precise terms in this instance between the upper part 905' of the plug (by virtue of snap-fastener teeth 980) and the internally toothed end of longitudinal spring lugs 978.

However, in this instance the spring lugs 978 are slightly different from those of the systems previously described in that they feature a shoulder 995 constituting an axial abutment for the plug 905 in the position of maximum extension of the sliding member 911.

Also repeated from previous embodiments are radial perforations 952 conferring greater longitudinal elasticity on the tubular part of the sliding member 911.

Finally, and also as previously, the sliding member 911 is surmounted by an externally screwthreaded dispensing nozzle 914 onto which the cap 913 screws by means of a tubular central portion 936 of the internally screwthreaded cap.

The principal advantages of this eighth embodiment lie in the absence of disposable parts (which avoids the patient experiencing any problem on reclosing the bottle, as the cap used to open it is employed for this), in the small number of component parts and in the high degree of security against "rescrewing" (relatively low protection against rotation supported in this instance by an axial translation abutment).

Figure 32:
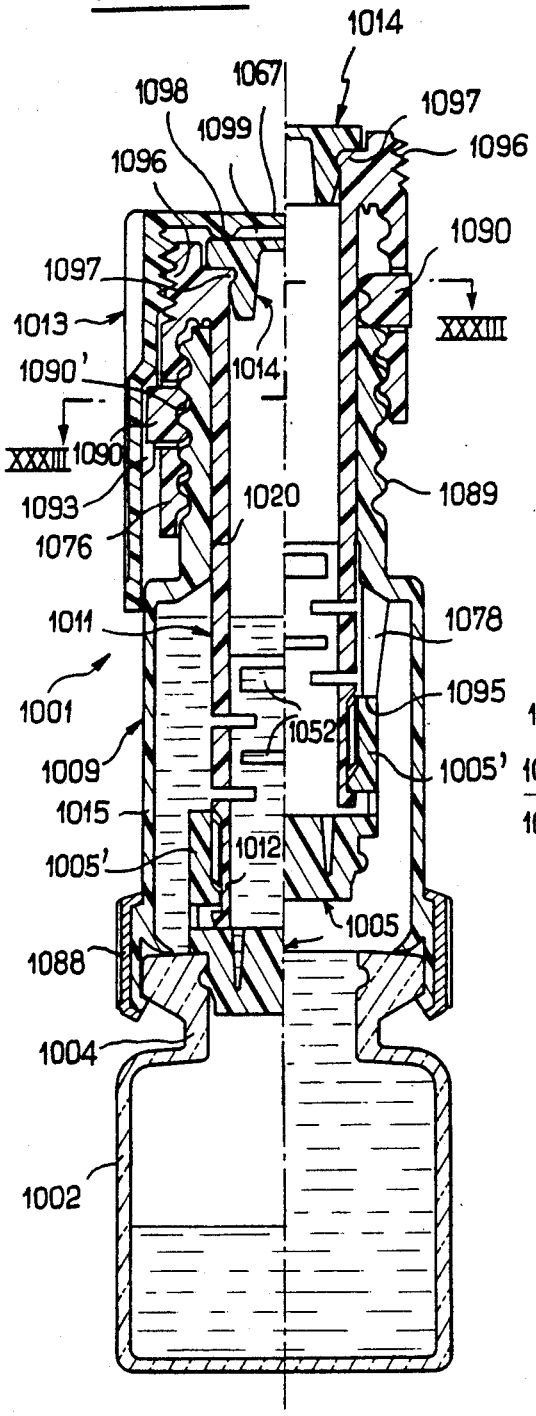
FIG. 32 is an axial cross-section showing a ninth embodiment of the invention in which the packaging and dispensing system comprises (as in the previous embodiment) a sliding member with retractable spring lugs onto which the cap screws with in this instance a dispensing nozzle comprising a plug adapted to be pierced by a syringe (the lefthand half-section corresponds to the packaging and the righthand half-section corresponds to opening of the system, the cap having been removed to provide access to the plug which can then be pierced by a syringe).
Figure 33:
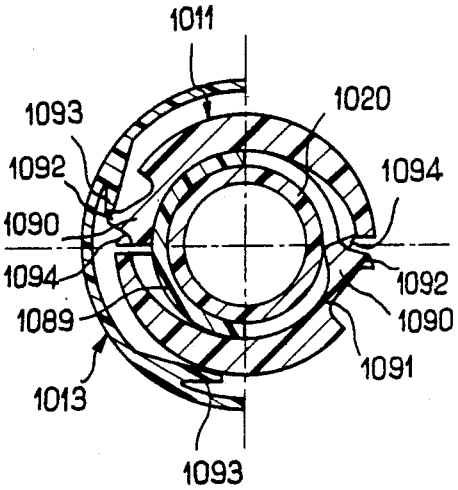
FIG. 33 is a cross-section on the line XXXIII—XXXIII in FIG. 32 showing a snap-fastener connection analogous to that of FIG. 30.

FIGS. 32 and 33 show a ninth embodiment of the invention derived from the previous embodiment.

The packaging and dispensing system 1001 comprises as previously a cap 1013 screwing onto a sliding member 1011 with retractable spring lugs 1090 cooperating with said cap.

Identical or similar parts will not be described again, but simply assigned reference numbers increased by 100.

The essential difference is found in the upper part of the device.

The upper part of the sliding member 1011 is closed by a plug 1014 which is adapted to be pierced by a syringe and which in this instance constitutes the dispensing nozzle and features above its internally screwthreaded sleeve 1076 an external screwthread 1096 onto which the cap 1013 screws, said cap having a closure bottom 1067 bearing against piercable plug 1014.

The piercable plug 1014 will generally be made from rubber or a suitable plastics material so that it can be readily pierced by the needle of a syringe.

The arrangement show also makes it possible to preserve to the greatest possible extent the sealing and sterility characterics.

The piercable plug 1014 is clamped between a shoulder 1097 on the sliding member 1011 and an annular boss 1098 projecting from the interior wall of the closure bottom 1067.

Thus not only does the seal remain perfect but there is also an additional advantage with regard to sterility: the annular boss 1098 delimits an area 1099 which remains sterile until the first use of the packaging and dispensing system, located between the interior wall of the closure bottom 1067 and the exterior wall of the piercable plug 1014, so that the needle of the syringe enters an area which is protected until the screwcap 1013 is opened for the operator to pierce the plug 1014.

It goes without saying that the invention is not limited to the various embodiments that have just been described, but to the contrary encompasses any variation thereon embodying, with equivalent means, the essential characteristics of the invention as defined in the appended claims.

I claim:

1. Packaging and dispensing system for packaging separately two ingredients at least one of which is a liquid and mixing said two ingredients extemporaneously at the time of first use, said system comprising:

a first bottle to contain the liquid or solid first ingredient and a plug to close the neck of said first bottle;

a second bottle to contain the liquid second ingredient, said second bottle comprising a main body with one end adapted to be assembled to said first bottle at the neck thereof;

a sliding member carried by said second bottle and adapted to be received telescope-fashion in the opposite end of said main body, said sliding member forming both an internal coupling member of elongate shape and a dispensing nozzle, wherein said coupling member has one end adapted to be coupled automatically to said plug closing said first bottle when said first and second bottles are assembled together;

an internally screwthreaded sleeve integral with said sliding member and adapted to cooperate with said opposite end of said main body which is externally screwthreaded and by virtue of which said sliding member is screw-coupled;

a cap screwed onto said sliding member and comprising internal teeth and a direct drive coupling to said sliding member in such a way that on said first use unscrewing said cap initially displaces said sliding member together with said plug and so automatically establishes the communication between said first and second bottles to enable safe mixing without prejudice to sterile conditions, and subsequently uncovers said dispensing nozzle, and wherein said externally screwthreaded sleeve of said sliding member comprises at least one retractable spring lug movable transversely and having on its interior a screwthread complementary to that of said sleeve and on its exterior a peg defining with said internal teeth on said cap a snap-fastener coupling between said cap and said sliding member effective when said screwthread on said spring lug is engaged with that on the end of said main body so as to define in a retracted position an axial translation abutment preventing retrograde movement of said sliding member and direct drive by said snap fastener-coupling, whereby screwing said cap on again cannot impart retrograde movement to said sliding member.

2. System according to claim 1 wherein said internally screwthreaded sleeve of said sliding member comprises two retractable spring lugs in an axially symmetrical corresponding relationship.

3. System according to claim 2 wherein each retractable spring lug has at its end a projection point cooperating in the retracted position with the adjacent interior screwthread of said sleeve so as to lock said lug in the retracted position.

4. System according to claim 1 wherein the coupling between the end of said sliding member and said plug also procures rotational locking, optionally by means of cooperation between splines and grooves, so that said plug is extracted by turning on unscrewing said cap.

5. System according to claim 1 wherein said main body has on its interior longitudinal lugs constituting an axial abutment for said plug in the position of maximum extension of said sliding member.

6. System according to claim 5 wherein the end of said longitudinal lugs includes internal teeth adapted to cooperate with snap-fastener teeth provided at the periphery of said plug to define supplementary rotational coupling means operative automatically in the position of maximum extension of said sliding member and providing a coupling between said main body and said plug only in the direction of unscrewing said cap.

7. System according to claim 1 wherein said sliding member has at the end opposite said dispensing nozzle and starting from said sleeve a tubular part the end of which provides the coupling with said plug, said tubular part comprising radial perforations for increased elasticity in a longitudinal direction.

8. System according to claim 1 wherein said sliding member is surmounted by an externally screwthreaded dispensing nozzle onto which said cap is adapted to be screwed by means of an internally screwthreaded tubular central portion of said cap.

* * * * *